US007623107B2

(12) United States Patent
Deane

(10) Patent No.: US 7,623,107 B2
(45) Date of Patent: Nov. 24, 2009

(54) DISPLAY DEVICES AND DRIVING METHOD THEREFOR

(75) Inventor: Steven C. Deane, Redhill (GB)

(73) Assignee: Chi Mei Optoelectronics Corporation, Tainan (TW)

( * ) Notice: Subject to any disclaimer, the term of this patent is extended or adjusted under 35 U.S.C. 154(b) by 579 days.

(21) Appl. No.: 11/571,569

(22) PCT Filed: Jul. 4, 2005

(86) PCT No.: PCT/IB2005/052221

§ 371 (c)(1),
(2), (4) Date: Jan. 3, 2007

(87) PCT Pub. No.: WO2006/006122

PCT Pub. Date: Jan. 19, 2006

(65) Prior Publication Data

US 2008/0013005 A1 Jan. 17, 2008

(30) Foreign Application Priority Data

Jul. 6, 2004 (GB) ..... 0415102.3

(51) Int. Cl.
*G09G 3/36* (2006.01)

(52) U.S. Cl. ..... 345/96; 345/58; 345/209; 345/690; 348/447; 349/37

(58) Field of Classification Search ..... 345/54, 345/58, 77, 79, 96, 102, 209, 690; 348/447, 348/615, 690; 349/37
See application file for complete search history.

(56) References Cited

U.S. PATENT DOCUMENTS

| | | | | |
|---|---|---|---|---|
| 6,803,894 | B1 * | 10/2004 | Hirota et al. | 345/88 |
| 7,053,876 | B2 * | 5/2006 | Kimura et al. | 345/98 |
| 7,180,488 | B2 * | 2/2007 | Hirakata | 345/87 |
| 7,352,346 | B2 * | 4/2008 | Angele et al. | 345/87 |
| 2001/0020929 | A1 * | 9/2001 | Nagata et al. | 345/98 |
| 2003/0107544 | A1 * | 6/2003 | Edwards | 345/96 |
| 2006/0028420 | A1 * | 2/2006 | Nagata et al. | 345/98 |

* cited by examiner

*Primary Examiner*—Henry N Tran
(74) *Attorney, Agent, or Firm*—Fish & Richardson P.C.

(57) ABSTRACT

Driving schemes are described in which rows (1 to m) are selected one at a time and column data voltages are inverted to provide inversion schemes for display devices comprising pixels (12) arranged in rows (1 to m) and columns (1 to n). The order in which rows are selected is such that a first group of first polarity rows is selected in a first order, a first group of second polarity rows is selected in a second order, a second group of first polarity rows is selected in the second order, and a second group of second polarity rows is selected in the first order, the first order being one of ascending or descending row number order, and the second order being the other of ascending or descending row number order.

10 Claims, 9 Drawing Sheets

42 44

| ROW NUMBER | DATA VOLTAGE POLARITY COL 1 | COL 2 | COL 3 | COL 4 | --→ |
|---|---|---|---|---|---|
| 1 | 1 | 1 | 1 | 1 | --→ |
| 2 | -1 | -1 | -1 | -1 | --→ |
| 3 | 1 | 1 | 1 | 1 | --→ |
| 4 | -1 | -1 | -1 | -1 | --→ |
| 5 | 1 | 1 | 1 | 1 | --→ |
| 6 | -1 | -1 | -1 | -1 | --→ |
| 7 | 1 | 1 | 1 | 1 | --→ |
| 8 | -1 | -1 | -1 | -1 | --→ |
| 9 | 1 | 1 | 1 | 1 | --→ |
| 10 | -1 | -1 | -1 | -1 | --→ |
| 11 | 1 | 1 | 1 | 1 | --→ |
| 12 | -1 | -1 | -1 | -1 | --→ |
| 13 | 1 | 1 | 1 | 1 | --→ |
| 14 | -1 | -1 | -1 | -1 | --→ |
| 15 | 1 | 1 | 1 | 1 | --→ |
| 16 | -1 | -1 | -1 | -1 | --→ |
| ↓ | ↓ | ↓ | ↓ | ↓ | |

FIG. 3

42 44

| ROW NUMBER | DATA VOLTAGE POLARITY COL 1 | COL 2 | COL 3 | COL 4 | --→ |
|---|---|---|---|---|---|
| 1 | 1 | -1 | 1 | -1 | --→ |
| 2 | -1 | 1 | -1 | 1 | --→ |
| 3 | 1 | -1 | 1 | -1 | --→ |
| 4 | -1 | 1 | -1 | 1 | --→ |
| 5 | 1 | -1 | 1 | -1 | --→ |
| 6 | -1 | 1 | -1 | 1 | --→ |
| 7 | 1 | -1 | 1 | -1 | --→ |
| 8 | -1 | 1 | -1 | 1 | --→ |
| 9 | 1 | -1 | 1 | -1 | --→ |
| 10 | -1 | 1 | -1 | 1 | --→ |
| 11 | 1 | -1 | 1 | -1 | --→ |
| 12 | -1 | 1 | -1 | 1 | --→ |
| 13 | 1 | -1 | 1 | -1 | --→ |
| 14 | -1 | 1 | -1 | 1 | --→ |
| 15 | 1 | -1 | 1 | -1 | --→ |
| 16 | -1 | 1 | -1 | 1 | --→ |
| ↓ | ↓ | ↓ | ↓ | ↓ | |

FIG. 4

42

| row | | | | | | | | | | | | | | | | | | | | | | | | |
|---|---|---|---|---|---|---|---|---|---|---|---|---|---|---|---|---|---|---|---|---|---|---|---|---|
| 1 | | | | | | | | | | | | -1 | | | | | | | | | | | | |
| 2 | 1 | | | | | | | | | | | | | | | | | | | | | | | |
| 3 | | | | | | | | | | | -1 | | | | | | | | | | | | | |
| 4 | | 1 | | | | | | | | | | | | | | | | | | | | | | |
| 5 | | | | | | | | | | -1 | | | | | | | | | | | | | | |
| 6 | | | 1 | | | | | | | | | | | | | | | | | | | | | |
| 7 | | | | | | | | | -1 | | | | | | | | | | | | | | | |
| 8 | | | | 1 | | | | | | | | | | | | | | | | | | | | |
| 9 | | | | | | | | -1 | | | | | | | | | | | | | | | | |
| 10 | | | | | 1 | | | | | | | | | | | | | | | | | | | |
| 11 | | | | | | | -1 | | | | | | | | | | | | | | | | | |
| 12 | | | | | | 1 | | | | | | | | | | | | | | | | | | |
| 13 | | | | | | | | | | | | | | | | | | | -1 | | | | | |
| 14 | | | | | | | | | | | | | | | | | | 1 | | | | | | |
| 15 | | | | | | | | | | | | | | | | | | | | -1 | | | | |
| 16 | | | | | | | | | | | | | | | | | 1 | | | | | | | |
| 17 | | | | | | | | | | | | | | | | | | | | | -1 | | | |
| 18 | | | | | | | | | | | | | | | | 1 | | | | | | | | |
| 19 | | | | | | | | | | | | | | | | | | | | | | -1 | | |
| 20 | | | | | | | | | | | | | | | 1 | | | | | | | | | |
| 21 | | | | | | | | | | | | | | | | | | | | | | | -1 | |
| 22 | | | | | | | | | | | | | | 1 | | | | | | | | | | |
| 23 | | | | | | | | | | | | | | | | | | | | | | | | -1 |
| 24 | | | | | | | | | | | | | 1 | | | | | | | | | | | |

time 46

FIG. 5

42

| row | | | | | | | | | | | | | | | | | | | | | | | | |
|---|---|---|---|---|---|---|---|---|---|---|---|---|---|---|---|---|---|---|---|---|---|---|---|---|
| 1 | | | | | | | | | | | | -1 | | | | | | | | | | | | |
| 2 | 1 | | | | | | | | | | | | | | | | | | | | | | | |
| 3 | | | | | | | | | | | -1 | | | | | | | | | | | | | |
| 4 | | 1 | | | | | | | | | | | | | | | | | | | | | | |
| 5 | | | | | | | | | | -1 | | | | | | | | | | | | | | |
| 6 | | | 1 | | | | | | | | | | | | | | | | | | | | | |
| 7 | | | | | | | | | -1 | | | | | | | | | | | | | | | |
| 8 | | | | 1 | | | | | | | | | | | | | | | | | | | | |
| 9 | | | | | | | | -1 | | | | | | | | | | | | | | | | |
| 10 | | | | | 1 | | | | | | | | | | | | | | | | | | | |
| 11 | | | | | | | -1 | | | | | | | | | | | | | | | | | |
| 12 | | | | | | 1 | | | | | | | | | | | | | | | | | | |
| 13 | | | | | | | | | | | | | | | | | | | | | | | | -1 |
| 14 | | | | | | | | | | | | | 1 | | | | | | | | | | | |
| 15 | | | | | | | | | | | | | | | | | | | | | | | -1 | |
| 16 | | | | | | | | | | | | | | 1 | | | | | | | | | | |
| 17 | | | | | | | | | | | | | | | | | | | | | | -1 | | |
| 18 | | | | | | | | | | | | | | | 1 | | | | | | | | | |
| 19 | | | | | | | | | | | | | | | | | | | | | -1 | | | |
| 20 | | | | | | | | | | | | | | | | 1 | | | | | | | | |
| 21 | | | | | | | | | | | | | | | | | | | | -1 | | | | |
| 22 | | | | | | | | | | | | | | | | | 1 | | | | | | | |
| 23 | | | | | | | | | | | | | | | | | | | -1 | | | | | |
| 24 | | | | | | | | | | | | | | | | | | 1 | | | | | | |

time

46

FIG. 8

DISPLAY DEVICES AND DRIVING METHOD THEREFOR

The present invention relates to display devices comprising pixels arranged in rows and columns, and to driving or addressing methods for such display devices. The present invention is particularly related to driving schemes in which column drive voltages are inverted to provide inversion schemes.

Liquid crystal display devices are well known, and usually comprise a plurality of pixels arranged in an array of rows and columns.

Conventionally the pixels are addressed or driven as follows. The rows of pixels are selected one at a time, starting with row one and working through the remaining rows in successive order, by application of a selection voltage. This is sometimes referred to as switching of the rows by means of a switching voltage. For display devices, e.g. active matrix liquid crystal display devices, where switching of the pixels is implemented using thin film transistors, such selecting or switching of individual rows is sometimes referred to as gating, as the switching voltage is applied to the gates of the transistors of the relevant row.

The pixels within the row currently selected are provided with respective display settings by virtue of respective data voltages being applied to each of the columns. Such data voltages are known by a number of names in the art, including data signals, video signals, image signals, drive voltages, column voltages, and so on.

Selection of each of the rows one by one, with driving of the columns as required during each row selection, provides display of one frame of the image being displayed. The display is then refreshed by a further frame being displayed in the same manner, and so on.

In addition, inversion schemes are implemented in many liquid crystal display devices. According to known inversion schemes, two different polarities of data voltage are employed (note these need not actually be positive and negative in an absolute sense, provided they produce opposite polarity voltages across the light modulating layer, e.g. liquid crystal layer, of the particular display device). Inversion schemes are employed to alleviate degradation of the liquid crystal material that would otherwise occur under continuous single-polarity operation.

Any given pixel has different polarities applied to it in different frames (usually alternating frames), i.e. the polarity for the pixel is inverted over time.

In addition, in some inversion schemes pixels are also inverted on a positional basis with respect to other pixels, as follows.

Considering first one column of pixels, different pixels are provided with different polarities. Typically, alternate pixels down the column are provided with different polarity of data voltage. This is performed by varying the polarity in time with the row selection procedure. If all the columns are given the same distribution of drive voltage polarity (i.e. all the pixels in a row have the same polarity), the inversion scheme is known as a row inversion scheme. However, if additionally, in each row, adjacent pixels are provided with different polarity, then the inversion scheme is known as a pixel inversion scheme, dot inversion scheme or checker board inversion scheme.

Thus in either pixel or row inversion schemes, the data voltages applied to a given column are inverted each time a new row is selected. However, the use of such schemes disadvantageously involves increased power consumption since power is consumed each time the data voltage applied to a column is inverted. Various addressing schemes have been devised for reducing the amount of power consumed by pixel or row inversion, by virtue of the schemes inverting the polarity less often than when the rows are selected on a conventional next row basis.

For example, US-A1-2003/0107544 describes a pixel or row inversion scheme in which the order in which rows are selected is such that a first plurality of successive rows of those rows to be driven with a first polarity are driven consecutively, followed by a first plurality of successive rows of those rows to be driven with a second polarity, followed by a second plurality of successive rows of those rows to be driven with the first polarity, and so on. WO 03/030137 describes another pixel or row inversion scheme in which the order in which rows are selected is such that two consecutive odd numbered rows are driven consecutively, followed by two consecutive even numbered rows, followed by the next two consecutive odd numbered rows, followed by the next two consecutive even numbered rows, and so on, and where furthermore each second pair of consecutive odd numbered rows and each second pair of consecutive even numbered rows are selected in reverse order within the pair. In a separate example, WO 03/030137 describes yet another pixel or row inversion scheme, in which the order in which rows are selected is such that two consecutive odd numbered rows are driven consecutively, followed by two consecutive even numbered rows but selected in reverse order, followed by the next two consecutive odd numbered rows driven consecutively, followed by the next two consecutive even numbered rows but selected in reverse order, and so on.

However, all of the above described addressing schemes which have been devised for reducing the amount of power consumed by pixel or row inversion tend to suffer, to some extent or other, from image artefacts introduced into the displayed image at rows where temporal changes in the driving polarity are made.

In a first aspect, the present invention provides a method of driving an array of pixels arranged in rows and columns; the method comprising: selecting the rows of pixels one row at a time; and applying respective data voltages to the columns of pixels each time a row is selected, the polarity of the data voltage applied to a given column being inverted between a first polarity and a second polarity such that positionally successive rows are driven with a different polarity of data voltage; selecting the rows of pixels one row at a time comprising the following steps performed in the following order:

(i) successively selecting, in a first order, the rows of a first group of first polarity rows being positionally successive rows of those rows being driven with the first polarity; (ii) successively selecting, in a second order, the rows of a first group of second polarity rows being positionally successive rows of those rows being driven with the second polarity, the rows of the first group of first polarity rows and the rows of the first group of second polarity rows being positionally interlaced such that together they are a plurality of positionally successive rows; (iii) successively selecting, in the second order, the rows of a second group of first polarity rows being positionally successive rows of those rows being driven with the first polarity; and (iv) successively selecting, in the first order, the rows of a second group of second polarity rows being positionally successive rows of those rows being driven with the second polarity, the rows of the second group of first polarity rows and the rows of the second group of second polarity rows being positionally interlaced such that together they are a plurality of positionally successive rows which positionally succeeds the plurality of positionally successive rows of, together, the first group of first polarity rows and the first group of second polarity rows; wherein the first order is one of ascending or descending row number order, and the second order is the other of ascending or descending row number order.

Each group of first polarity rows or second polarity rows may comprise three or more rows.

The pixels may be pixels of an active matrix liquid crystal display.

In a further aspect, the present invention provides display driver apparatus for driving an array of pixels arranged in rows and columns, comprising: means for selecting the rows of pixels one row at a time; and means for applying respective data voltages to the columns of pixels each time a row is selected, the polarity of the data voltage applied to a given column being inverted between a first polarity and a second polarity such that positionally successive rows are driven with a different polarity of data voltage; the means for selecting the rows of pixels one row at a time being adapted to perform selection of the rows by implementing the following steps in the following order:

(i) successively selecting, in a first order, the rows of a first group of first polarity rows being positionally successive rows of those rows being driven with the first polarity; (ii) successively selecting, in a second order, the rows of a first group of second polarity rows being positionally successive rows of those rows being driven with the second polarity, the rows of the first group of first polarity rows and the rows of the first group of second polarity rows being positionally interlaced such that together they are a plurality of positionally successive rows; (iii) successively selecting, in the second order, the rows of a second group of first polarity rows being positionally successive rows of those rows being driven with the first polarity; and (iv) successively selecting, in the first order, the rows of a second group of second polarity rows being positionally successive rows of those rows being driven with the second polarity, the rows of the second group of first polarity rows and the rows of the second group of second polarity rows being positionally interlaced such that together they are a plurality of positionally successive rows which positionally succeeds the plurality of positionally successive rows of, together, the first group of first polarity rows and the first group of second polarity rows; wherein the first order is one of ascending or descending row number order, and the second order is the other of ascending or descending row number order.

Each group of first polarity rows or second polarity rows may comprise three or more rows.

In a further aspect, the present invention provides a method of driving an array of pixels arranged in rows and columns; the method comprising: selecting the rows of pixels one row at a time; and applying respective data voltages to the columns of pixels each time a row is selected, the polarity of the data voltage applied to a given column being inverted between a first polarity and a second polarity such that positionally successive rows are driven with a different polarity of data voltage; selecting the rows of pixels one row at a time comprising the following steps performed in the following order:

(i) successively selecting, in a first order, the rows of a first group of three or more first polarity rows being positionally successive rows of those rows being driven with the first polarity; and (ii) successively selecting, in a second order, the rows of a first group of three or more second polarity rows being positionally successive rows of those rows being driven with the second polarity, the rows of the first group of first polarity rows and the rows of the first group of second polarity rows being positionally interlaced such that together they are a plurality of positionally successive rows; wherein the first order is one of ascending or descending row number order, and the second order is the other of ascending or descending row number order.

The pixels may be pixels of an active matrix liquid crystal display.

In a further aspect, the present invention provides display driver apparatus for driving an array of pixels arranged in rows and columns, comprising: means for selecting the rows of pixels one row at a time; and means for applying respective data voltages to the columns of pixels each time a row is selected, the polarity of the data voltage applied to a given column being inverted between a first polarity and a second polarity such that positionally successive rows are driven with a different polarity of data voltage; the means for selecting the rows of pixels one row at a time being adapted to perform selection of the rows by implementing the following steps in the following order:

(i) successively selecting, in a first order, the rows of a first group of three or more first polarity rows being positionally successive rows of those rows being driven with the first polarity; and (ii) successively selecting, in a second order, the rows of a first group of three or more second polarity rows being positionally successive rows of those rows being driven with the second polarity, the rows of the first group of first polarity rows and the rows of the first group of second polarity rows being positionally interlaced such that together they are a plurality of positionally successive rows; wherein the first order is one of ascending or descending row number order, and the second order is the other of ascending or descending row number order.

In further aspects, the present invention provides a display device comprising an array of pixels arranged in rows and columns, and display driver apparatus as described above.

In a further aspect, the present invention provides driving schemes in which rows are selected one at a time and column data voltages are inverted to provide inversion schemes for display devices comprising pixels arranged in rows and columns. The order in which rows are selected is such that a first group of first polarity rows is selected in a first order, a first group of second polarity rows is selected in a second order, a second group of first polarity rows is selected in the second order, and a second group of second polarity rows is selected in the first order, the first order being one of ascending or descending row number order, and the second order being the other of ascending or descending row number order.

The present inventor has determined that a cause of or contribution to the earlier described image artefacts arises since due to parasitic capacitance effects, the pixel responds to a root-mean-square voltage ($V_{rms}$) which would tend to vary smoothly with consecutive lines, but by selecting the rows temporally in a positionally non-consecutive order the variation in $V_{rms}$ no longer occurs smoothly in terms of the positionally consecutive rows. The present inventor has further determined that the human eye is not very sensitive to a brightness variation between two positionally consecutive rows, and has realised that driving schemes in which the average brightness over two positionally consecutive rows remains reasonably constant over the course of a larger number of positionally consecutive rows (for a given uniform data level) will tend to reduce the level of image artefacts introduced by a power saving driving scheme. Such schemes are presented in the various aspects of the invention given above.

Embodiments of the present invention will now be described, by way of example, with reference to the accompanying drawings, in which:

FIG. 1 is a schematic diagram of an active matrix liquid crystal display device in which embodiments of the invention is implemented;

FIG. 2*a* shows a positive polarity data voltage being applied to a pixel of the display device of FIG. 1;

FIG. 2*b* shows a negative polarity data voltage being applied to the same pixel of the display device of FIG. 1;

FIG. 3 shows a row inversion scheme applied to the display device of FIG. 1;

FIG. 4 shows a pixel inversion scheme applied to the display device of FIG. 1;

FIG. 5 shows a driving scheme;

FIG. 8 shows another driving scheme; and

Figure 1:
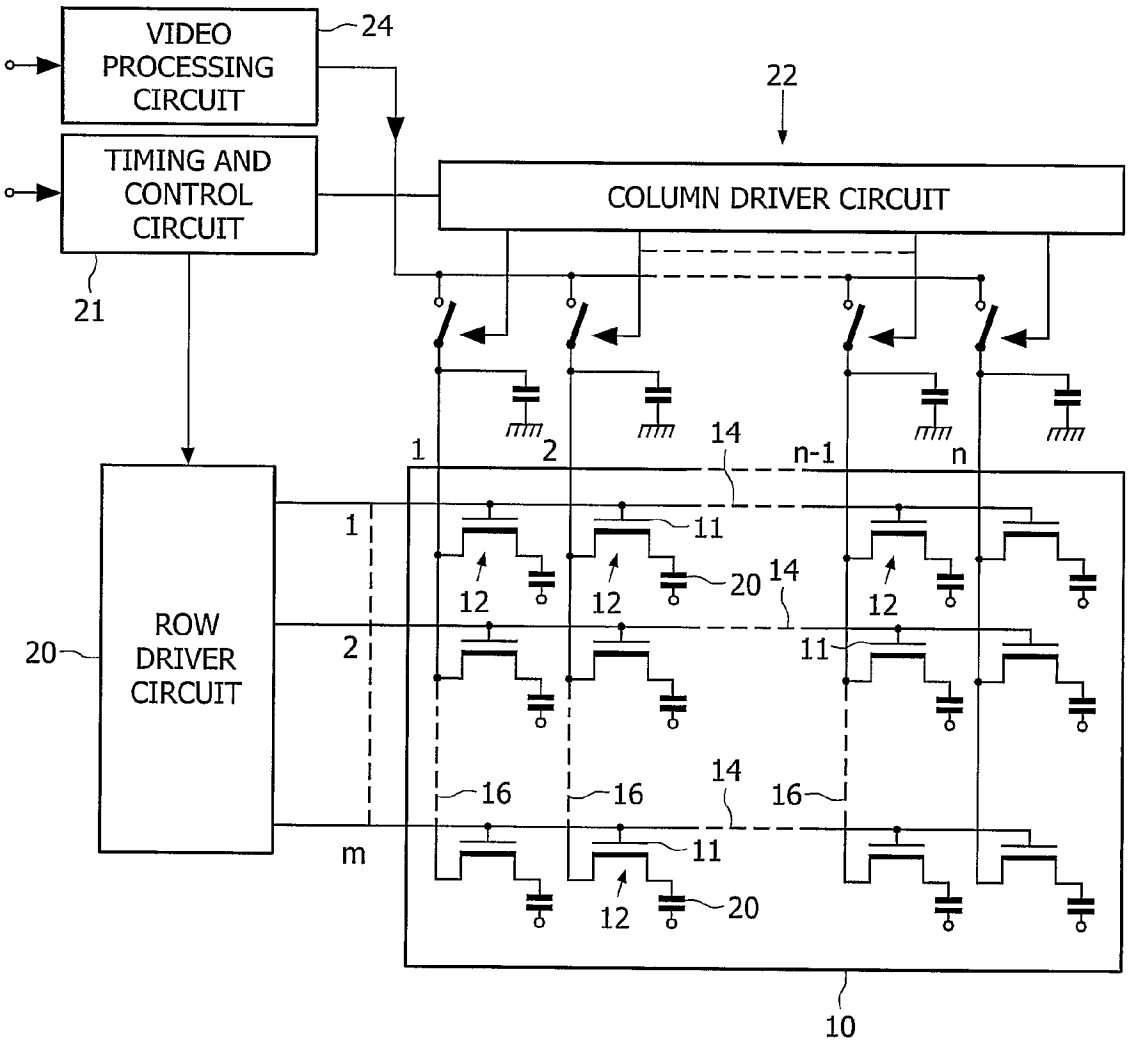

FIG. 1 is a schematic diagram of an active matrix liquid crystal display device in which embodiments of the invention are implemented. The display device, which is suitable for displaying video pictures, comprises an active matrix addressed liquid crystal display panel 10 having a row and column array of pixels which consists of m rows (1 to m) with n horizontally arranged pixels 12 (1 to n) in each row. Only a few of the pixels are shown for simplicity.

Each pixel 12 is associated with a respective switching device in the form of a thin film transistor, TFT, 11. The gate terminals of all TFTs 11 associated with pixels in the same row are connected to a common row conductor 14 to which, in operation, selection (gating) signals are supplied. Likewise, the source terminals associated with all pixels in the same column are connected to a common column conductor 16 to which data (video) signals are applied. The drain terminals of the TFTs are each connected to a respective transparent pixel electrode 20 forming part of, and defining, the pixel. The conductors 14 and 16, TFTs 11 and electrodes 20 are carried on one transparent plate while a second, spaced, transparent plate carries an electrode common to all the pixels (hereinafter referred to as the common electrode). Liquid crystal is disposed between the plates.

The display panel is operated in conventional manner. Light from a light source disposed on one side enters the panel and is modulated according to the transmission characteristics of the pixels 12. The device is driven one row at a time by scanning the row conductors 14 with a selection (gating) signal so as to turn on the rows of TFTs in turn and applying data (video) signals to the column conductors for each row of picture display elements in turn as appropriate and in synchronism with the selection signals so as to build up a complete display frame (picture). The order in which the rows are selected during the scanning will be described below. Using one row at time addressing, all TFTs 11 of the selected row are switched on for a period determined by the duration of the selection signal corresponding to a TV line time during which the video information signals are transferred from the column conductors 16 to the pixels 12. Upon termination of the selection signal, the TFTs 11 of the row are turned off for the remainder of the frame period, thereby isolating the pixels from the conductors 16 and ensuring the applied charge is stored on the pixels until the next time they are addressed in the next frame period.

The row conductors 14 are supplied in their order of selection with selection signals by a row driver circuit 20 comprising a digital shift register controlled by regular timing pulses from a timing and control circuit 21. In the intervals between selection signals, the row conductors 14 are supplied with a substantially constant reference potential by the drive circuit 20. Video information signals are supplied to the column conductors 16 from a column driver circuit 22, here shown in basic form, comprising one or more shift register/sample and hold circuits. The circuit 22 is supplied with video signals from a video processing circuit 24 and timing pulses from the circuit 21 in synchronism with row scanning to provide serial to parallel conversion appropriate to the row at a time addressing of the panel 10.

Other details of the liquid crystal display device, except where otherwise stated below in relation to the order in which the rows are selected in relation to their column polarity, may be as per any conventional active matrix liquid crystal display device, and are in the present particular embodiments the same as, and operate the same as, the liquid crystal display device disclosed in U.S. Pat. No. 5,130,829, the contents of which are contained herein by reference.

Figure 2A:
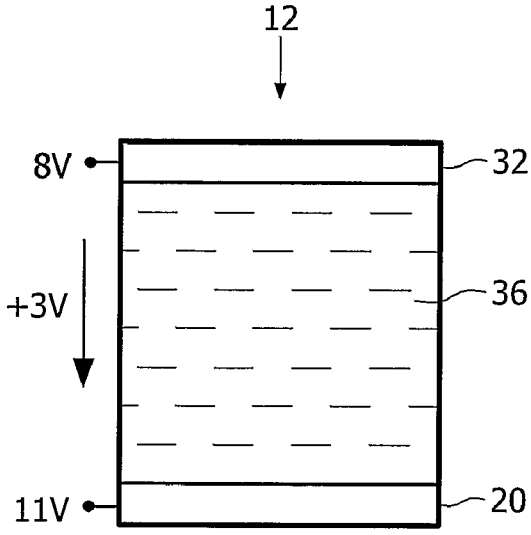
Figure 2B:
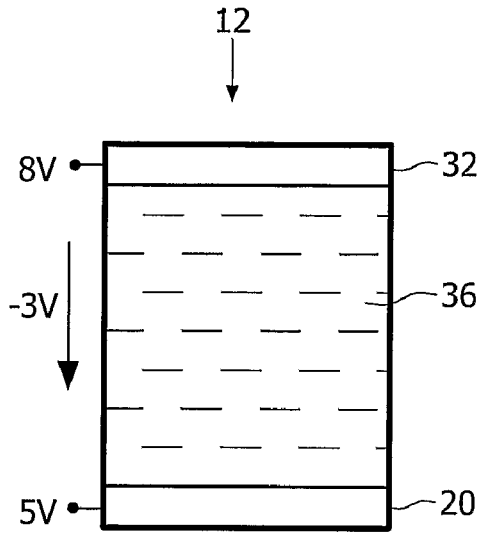

The way in which the data voltage, as applied to the columns, is varied between two polarities, will now be explained with reference to FIGS. 2*a* and 2*b*. FIGS. 2*a* and 2*b* each show schematically (not to scale) an above mentioned pixel 12, formed (inter-alia) from a pixel electrode 20, the (corresponding portion of) the above mentioned common electrode (indicated by reference numeral 32 in FIGS. 2*a* and 2*b*), and (the corresponding portion of) the liquid crystal layer therebetween (indicated by reference numeral 36 in FIGS. 2*a* and 2*b*).

The common electrode 32 is maintained at a constant reference voltage, in this example 8V, as shown in both FIGS. 2*a* and 2*b*. FIG. 2*a* shows the case when a positive polarity data voltage is applied to the pixel. In this example a voltage of 11 v is applied to the pixel electrode 20, as shown, providing a potential difference across the liquid crystal layer of +3V (referenced to the common electrode 32). In this example, this is the positive polarity. In a grey scale display the magnitude of this potential difference provides the relevant grey scale, due to voltage magnitude dependence of the electro-optic effect of the light modulating layer, i.e. the liquid crystal layer 36. However, if the display were binary, then the magnitude of the potential difference would simply correspond to a fully on state.

FIG. 2*b* shows the case when a negative polarity data voltage is applied to the pixel. More particularly, the situation shown is when the same magnitude (3V) of potential difference is required as was applied in the FIG. 2*a* example. Thus in this case a voltage of 5V is applied to the pixel electrode, resulting in the required −3V potential difference across the liquid crystal layer (referenced to the common electrode 32).

It is noted that in both FIGS. 2*a* and 2*b* the voltage applied to the pixel electrode 20 is, in an absolute sense, positive. However, the 5V signal provides a negative polarity across the liquid crystal layer 36, whereas the 11V signal provides a positive polarity across the liquid crystal layer 36. Thus, in this specification, the terminology positive and negative polarity of data voltage is to be understood to include examples such as those described with reference to FIGS. 2*a* and 2*b*, as well as other examples where, say, the common electrode is held at 0V, and the positive and negative polarity applied data voltages are indeed positive and negative in an absolute sense as well as in the sense of the resulting potential drop across the light modulating layer.

Also, although in the example shown in FIGS. 2*a* and 2*b*, the common electrode 32 is held at a d.c. potential (here 8V), in other drive schemes (known as common electrode drive schemes) the common electrode is driven with an inverting square waveform, and the present invention may equally be implemented with such schemes.

The present embodiments may be applied to either a row inversion scheme or a pixel inversion scheme. It is convenient to first describe in more detail what is meant by these. FIG. 3 shows a row inversion scheme applied to the above described device. FIG. 3 shows, for one frame, the polarity (where a "1" indicates a positive polarity, and a "−1" indicates a negative polarity) of data voltage (indicated in general by reference numeral 44) for each of the columns of the above described device (for clarity only the first four columns are shown) as applied to each row number (indicated in general by reference numeral 42). For clarity only the first 16 rows, i.e. rows 1-16 are shown.

For column 1, row 1 is positive, and thereafter the polarity is alternated for successive rows, i.e. row 2 is negative, row 3 is positive, and so on. All the other columns, e.g. columns 2, 3 and 4 as shown, have the same polarities for the same rows as per column 1. Thus, as can be seen, any given row has the same polarity across all the columns, i.e. the inversion takes place on a row basis, hence the terminology "row inversion" is used to describe this arrangement.

FIG. 4 on the other hand shows a pixel inversion scheme applied to the above described device. FIG. 4 also shows, for one frame, the polarity (where again a "1" indicates a positive polarity, and a "−1" indicates a negative polarity) of data voltage (indicated in general by reference numeral 44) for each of the columns of the above described device (for clarity only the first four columns are shown) as applied to each row number (indicated in general by reference numeral 42). For clarity only the first 16 rows, i.e. rows 1-16 are shown.

For column 1, row 1 is positive, and thereafter the polarity is alternated for successive rows, i.e. row 2 is negative, row 3 is positive, and so on. So far this is the same as per FIG. 3. However, as shown in FIG. 4, for column 2, the positive and negative polarities are reversed compared to column 1. This pattern is repeated for alternating columns, i.e. column 3 is the same as column 1, column 4 is the same as column 2, and so on. Thus, as can be seen, any two neighbouring pixels are of opposite polarity, hence the terminology "pixel inversion" is used to describe this arrangement.

In another form of pixel inversion, applied to some colour liquid crystal displays, three adjacent columns (one for each of the colours red, blue and green) have a first polarity for a given row, then the next three adjacent columns have the other polarity, and so on.

The situation for each of the above described row or pixel inversion schemes has been explained in terms of the polarities applied in one frame. In the next frame, the positive polarities and negative polarities are reversed.

The present embodiments may be applied equally to any of the above described row or pixel inversion schemes. For clarity, the embodiments will be described in terms of column 1 (e.g. of FIGS. 3 and 4) only.

FIG. 5 shows a driving scheme according to a first embodiment. FIG. 5 shows, for one frame, the polarity (where a "1" indicates a positive polarity, and a "−1" indicates a negative polarity) of data voltage (indicated by reference numeral 44) for a single column of the above described device as applied to each row number (indicated by reference numeral 42). For clarity only the first 24 rows, i.e. rows 1-24 are shown. FIG. 5 further shows the temporal order in which the rows are selected, as indicated by the time arrow 46. Thus, the first row to be selected is that whose polarity is shown in the far left column, i.e. row 2 which is driven with a positive polarity, then row 4 is selected and driven with a positive polarity, and so on. Thus it can be seen that the order of selection of the 24 rows shown in FIG. 5 is as follows (where +ve indicates positive polarity and −ve indicates negative polarity):

row 2 (+ve), row 4 (+ve), row 6 (+ve), row 8 (+ve), row 10 (+ve), row 12 (+ve), row 11 (−ve), row 9 (−ve), row 7 (−ve), row 5 (−ve), row 3 (−ve), row 1 (−ve), row 24 (+ve), row 22 (+ve), row 20 (+ve), row 18 (+ve), row 16 (+ve), row 14 (+ve), row 13 (−ve), row 15 (−ve), row 17 (−ve), row 19 (−ve), row 21 (−ve), row 23 (−ve).

The order of selection of the rows is based on groups of rows comprising six rows, such that a first group comprising the first six rows to be driven with positive polarity (i.e. rows 2, 4, 6, 8, 10 and 12) is selected in ascending row number order (i.e. in the order 2, 4, 6, 8, 10 12); following which a second group comprising the first six rows to be driven with negative polarity (i.e. rows 1, 3, 5, 7, 9 and 11) is selected in descending, i.e. reverse, row number order (i.e. in the order 11, 9, 7, 5, 3, 1); following which a third group comprising the next six rows to be driven with positive polarity (i.e. rows 14, 16, 18, 20, 22 and 24) is selected in descending, i.e. reverse, row number order (i.e. in the order 24, 22, 20, 18, 16, 14); following which a fourth group comprising the next six rows to be driven with negative polarity (i.e. rows 13, 15, 17, 19, 21, 23) is selected in ascending row number order (i.e. in the order 13, 15, 17, 19, 21, 23). The remaining rows of the device, i.e. row 25 onwards (not shown in FIG. 5) are selected by repeating this cycle of:

a next positive polarity group comprising the next six rows to be driven with positive polarity is selected in ascending row number order; following which a next negative polarity group comprising the next six rows to be driven with negative polarity is selected in descending, i.e. reverse, row number order; following which a next positive polarity group comprising the next six rows to be driven with positive polarity is selected in descending, i.e. reverse, row number order; following which a next negative polarity group comprising the next six rows to be driven with negative polarity is selected in ascending row number order; and so on.

In the arrangement shown in FIG. 1, the row driver circuit 20, the timing and control circuit 21, the column driver circuit 22 and the video processing unit 24 may together be considered to form a display driver apparatus. Such a display driver apparatus may be adapted in any suitable manner to implement the row selection ordering of this embodiment. For example, the row driver circuit 20 may be programmed to select the rows in the order described above, the column driver circuit may be adapted to switch the column polarities as described, and the video processing circuit may be adapted by provision of a buffer or memory (not shown) for storing video data for those rows not selected in their numerical order, i.e. the buffer may store the video data for rows 1, 3, 5, 7, 9 and 11 whilst rows 2, 4, 6, 8, 10 and 12 are selected, then use the stored video data when rows 1, 3, 5, 7, 9 and 11 are later selected after rows 2, 4, 6, 8, 10 and 12.

Figure 6:
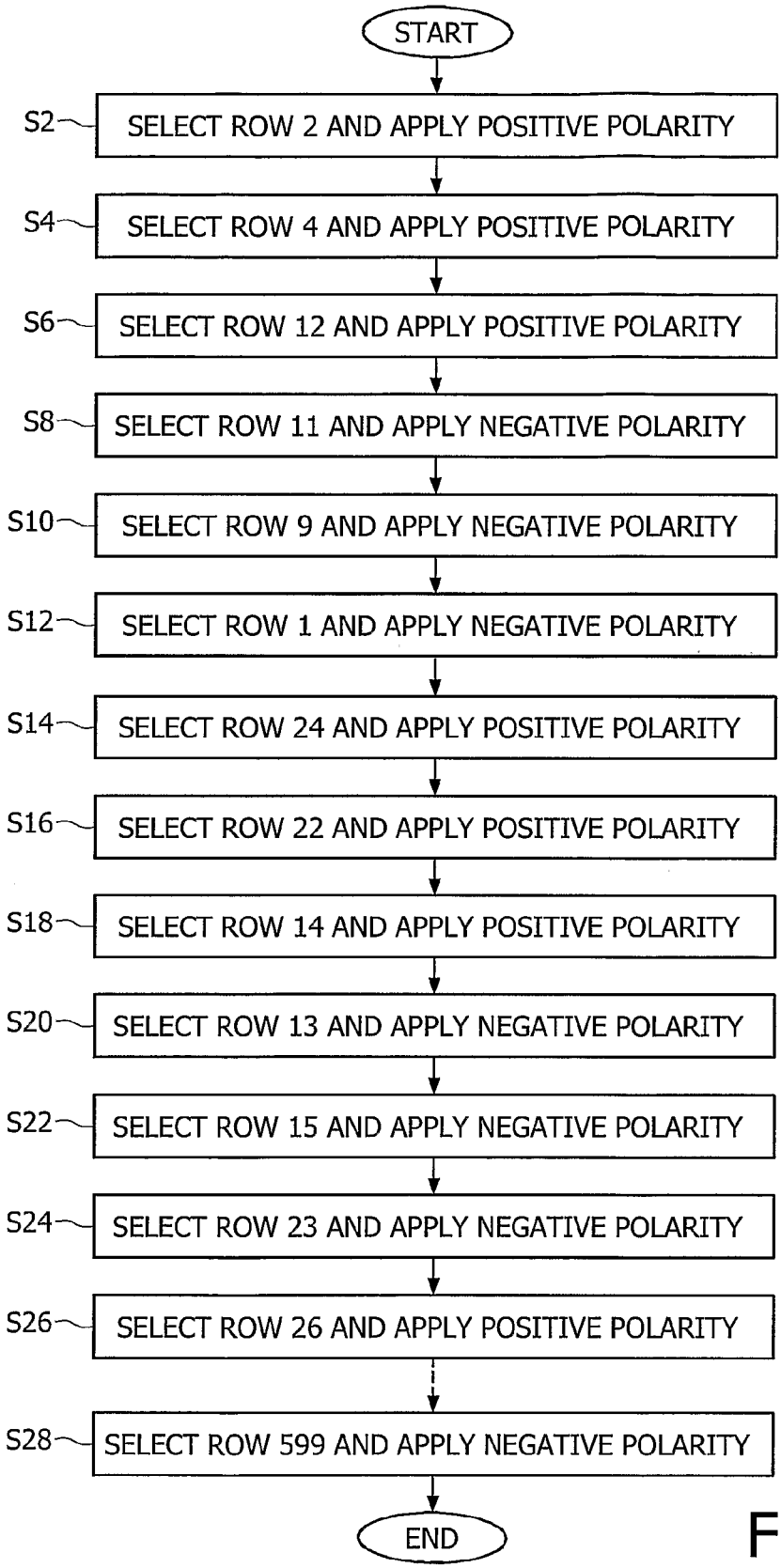
FIG. 6 is a flowchart showing process steps carried out by display driver apparatus implementing the driving scheme of FIG. 5.

FIG. 6 is a flowchart showing process steps carried out by the display driver apparatus in this embodiment to provide, for a single frame, the row ordering and polarities shown in FIG. 5, for the row inversion case.

At step s2, row 2 is selected and a positive polarity data voltage is applied to each column. Row 2 is selected by the row driver circuit 20 applying a selection voltage to row 2. Application of the positive polarity data voltage is implemented as follows. A video signal (i.e. specifying the magnitude of the data voltage to be applied to each column) is provided by the video processing circuit 24 and effectively sampled at the correct time for each column by virtue of the column driver circuit 22 connecting the video signal to the respective columns at the right times, under timing control of the timing and control circuit 21. Whether the polarity is positive or negative is controlled and implemented by a combination of the column driver circuit 22 and the video processing circuit 24 under the control of the timing and control circuit 21.

If the column driver circuit 22 is only implementing row and field inversion it may be supplied with video signals from the video processing circuit 24 which are inverted in polarity either every field (frame) or every field (frame) and every row. In this case the video processing circuit 24 carries out the switching between the two drive voltage polarities.

If the column driver circuit 22 is implementing pixel inversion then the video processing circuit 24 supplies the column driver circuit 22 with two sets of video signals. At any moment in time one of these sets is positive and the other negative. Signals from one or other of these two sets of inputs are directed to alternate columns in the display in order to provide the required drive polarities. The video processing circuit 24 may swap over the polarity of these two sets of signals row by row and at the end of each field, although this function may also be integrated into the column driver circuit 22.

At step s4, the next row is selected, namely row 4, as this is the next consecutive row of the first group of six rows which are to have positive polarity applied thereto, and a positive polarity data voltage is applied to each of the columns.

This process is repeated (indicated by a broken arrow between step s4 and s6 in FIG. 5) for the remaining rows of the first group of six rows which are to have positive polarity applied thereto until, at step s6, row 12 is selected and a positive polarity data voltage is applied to each of the columns.

In this embodiment, the number of rows forming a "group" is six, hence the next six rows to be selected will be the first group of negative polarity rows (i.e. rows 1, 3, 5, 7, 9, and 11). Furthermore, as described above, this group will be selected in descending, i.e. reverse, row number order (i.e. 11, 9, 7, 5, 3, 1).

Thus, at step s8, row 11 is selected and a negative polarity data voltage is applied to each column. Next, at step s10, row 9 is selected and a negative polarity data voltage is applied to each column. This process is repeated (indicated by a broken arrow between step s10 and s12 in FIG. 5) for the remaining rows of the first group of six rows which are to have negative polarity applied thereto until, at step s12, row 1 is selected and a negative polarity data voltage is applied to each of the columns.

The next six rows to be selected will be the next group, i.e. the second group, of positive polarity rows (i.e. rows 14, 16, 18, 20, 22 and 24). Furthermore, as described above, this group will be selected in descending, i.e. reverse, row number order (i.e. in the order 24, 22, 20, 18, 16, 14).

Thus at step s14, row 24 is selected and a positive polarity data voltage is applied to each column. Next, at step s16, row 22 is selected and a positive polarity data voltage is applied to each column. This process is repeated (indicated by a broken arrow between step s16 and s18 in FIG. 5) for the remaining rows of the second group of six rows which are to have positive polarity applied thereto until, at step s18, row 14 is selected and a positive polarity data voltage is applied to each of the columns.

The next six rows to be selected will be the next group, i.e. the second group, of negative polarity rows (i.e. rows 13, 15, 17, 19, 21, 23). As described above, this group will be selected in ascending row number order (i.e. in the order 13, 15, 17, 19, 21, 23).

Thus, at step s20, row 13 is selected and a negative polarity data voltage is applied to each column. Next, at step s22, row 15 is selected and a negative polarity data voltage is applied to each column. This process is repeated (indicated by a broken arrow between step s22 and s24 in FIG. 5) for the remaining rows of the second group of six rows which are to have negative polarity applied thereto until, at step s24, row 23 is selected and a negative polarity data voltage is applied to each of the columns.

As described above, the remaining rows are selected and have positive or negative polarity applied to the columns in a repeat of the cycle described for rows 1-24 by allocating the rows into groups of six consecutive rows of a given polarity, then selecting them (and applying appropriate polarity data voltage to the columns) according to the cycle of:

the next group of positive polarity rows selected in ascending row number order (the first these being shown in FIG. 5 as step s26, in which row 26 is selected and a positive polarity data voltage is applied to each column), then the next group of negative polarity rows selected in descending row number order, then the next group of positive polarity rows selected in descending row number order, then the next group of negative polarity rows selected in ascending row number order, and so on (indicated by a broken arrow between step s26 and s28 in FIG. 5) until at step s28 the last to be selected row, i.e. the (m−1)th row (in this embodiment, where the display has say 600 rows by 800 columns, row 599) is selected and a negative polarity data voltage is applied to each column (the mth row, here row 600, having been selected previously as part of the last group of positive polarity rows).

This completes addressing of this frame. During addressing of the next frame, the positive and negative polarities are reversed, but the rows are selected in the order given above.

In the above described process, the row is selected then the voltage is applied to the column. Alternatively, this order may be reversed. Whichever order is used, it is usual for the column voltage to be held until after the row has been deselected.

Figure 7:
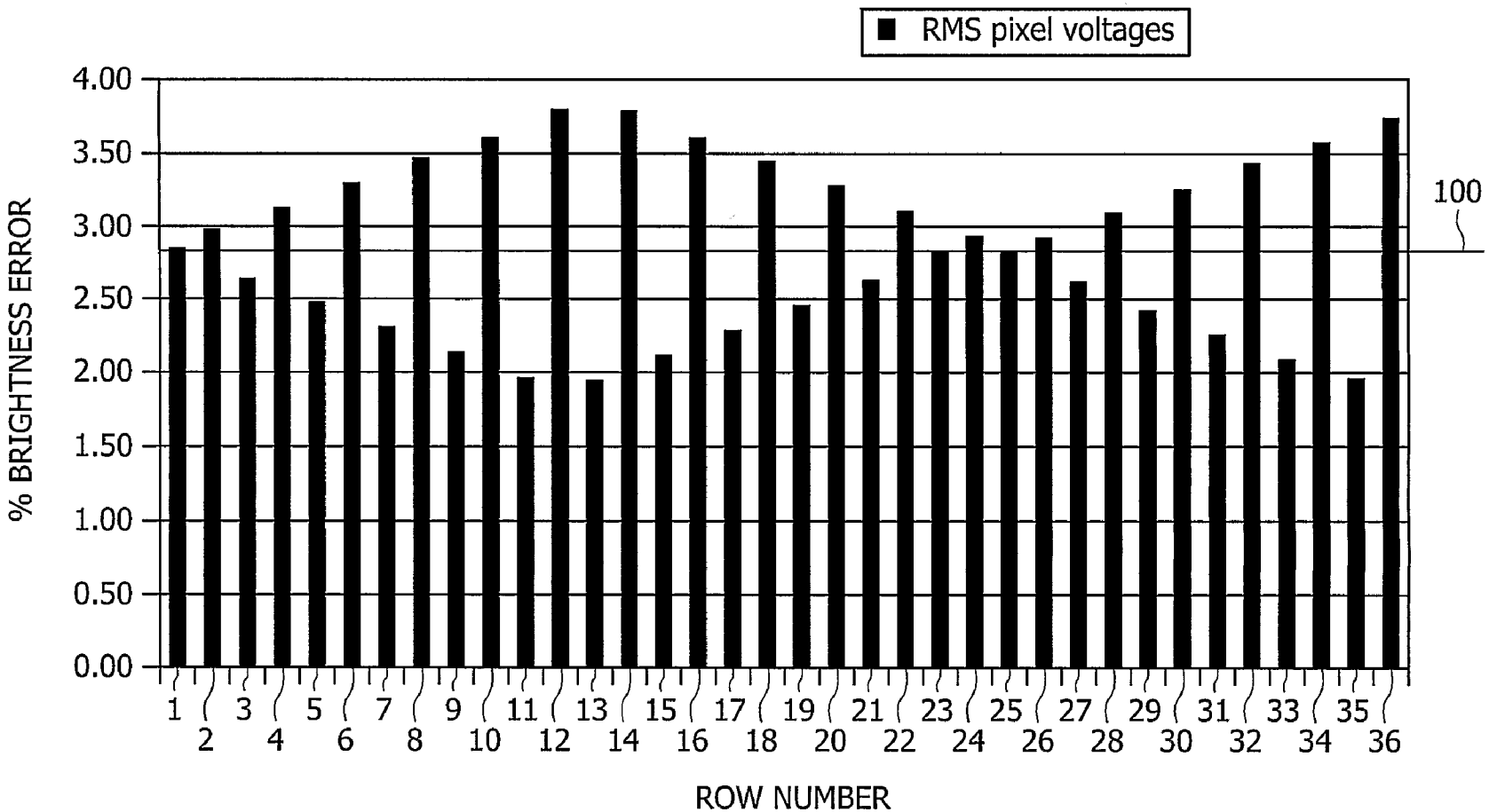
FIG. 7 is a prediction derived from predictive modelling of brightness error of each row in terms of the positional row number for a display device driven using the driving scheme of FIG. 5.

Advantageous effects that tend to be achieved by implementing the above described driving scheme will now be described conceptually with reference to FIG. 7. FIG. 7 is a prediction derived from predictive modelling of brightness error (ordinate) of each row in terms of the positional row number (abscissa) for a display device driven using the above described scheme. It is noted for completeness that the display details used in the prediction model are not necessarily the same as those of the particular display device described above with respect to FIGS. 1 and 2; however, the predictive results still serve to aid explanation of the concepts involved.

It can be seen from FIG. 7 that the brightness variation between two positionally adjacent rows, e.g. row 12 compared to row 13, can be relatively high. However, the present inventor has realised that this can be accommodated, since the eye is not particularly sensitive to brightness variations that cancel out over neighbouring rows. The present inventor has instead surprisingly derived this driving scheme by considering the average brightness error for any two positionally adjacent rows. This average is shown approximately as line 100 in FIG. 7. It can be seen that this average (line 100 in FIG. 7) is approximately uniform and smooth over all the rows by virtue of the above described driving scheme. This consequently provides an advantageous reduction (or tendency to reduce) in visible horizontal bands or other image artefacts. In particular, groups of six rows of the same polarity can be driven consecutively, hence saving power, but artefacts in the form of groups of six rows or at the interface of groups of six rows are removed or at least tend to be reduced.

Of particular note is how, in the region of row 12 and 13, the average brightness (line 100 in FIG. 7) remains uniform despite the big difference in brightness error between row 12 and row 13. This derives in particular from the aspect exemplified by the selection process described above with reference to FIGS. 5 and 6, in which a given group of rows of a given polarity (i.e. in the example, the first group of negative polarity rows, i.e. rows 1, 3, 5, 7, 9, and 11) is driven in the opposite sense of ascending or descending row number order compared to the group of the other polarity preceding it (i.e. in the example, the first group of positive polarity rows, i.e. rows 2, 4, 6, 8, 10 and 12) but is driven in the same sense of ascending or descending row number order as the group of the other polarity following it (i.e. in the example, the second group of positive polarity rows, i.e. rows 14, 16, 18, 20, 22 and 24). In other words, this derives from selecting the rows within a group (as defined earlier) of rows of a first polarity in a first order (which may also be considered as a "direction") in the sense of either ascending or descending row number order, followed by selecting rows within the corresponding group of rows of the other polarity in the other order (direction), then selecting the rows within the next group of rows of the first polarity and the rows within the corresponding next group of rows of the other polarity in respective reversed orders (directions).

It should be borne in mind that the scheme has been described in detail for a given frame, however the polarities will then reverse in the next frame.

Hence, whereas in the frame described above, the even numbered rows have positive polarity, in the next frame the odd numbered rows will have positive polarity.

Furthermore, various variations can be made to the above described addressing scheme whilst maintaining the underlying concept described in the preceding two paragraphs. For example, row 1 may be selected first, rather than row 2 as in the above example. In this case the other rows will be selected according to the principles outlined above. Also, for example, the basic cycle outlined above may be employed, without starting as such at the start of the cycle as described above. For example, instead of the rows within the first group of rows being selected in ascending row number order, with the rows within the following groups selected in ascending or descending order (direction) as described above, the rows within the first group of rows may be selected in descending row order number, in which case the rows within the following groups will be selected in ascending or descending order as required to follow the concepts described above. Furthermore, such a variation may be introduced to accommodate a display with a number of rows that does not divide evenly into the number of rows intended to be allocated to each group.

Another possibility is the scheme may only be applied to some of the rows of the display, rather than all the rows of the display. Or the display may be divided into two or more regions of rows, with the scheme being applied to each of these regions separately.

Another possible variation is as follows. In the above described embodiment, the rows are processed, i.e. selected consecutively, in groups of six successive rows to be driven with the same polarity. However, in other embodiments, this number may be different, i.e. the rows may be allocated into such groups of any number from 2 upwards, as required. The larger the number, the less often the polarity needs to be switched per column, and hence the greater the power saving. However, a trade-off is involved, because when a larger number is chosen, the other polarity rows receive their selection later, and hence any moving image artefacts remaining despite the advantages of the present invention may be more marked. Also, the drive circuitry and/or missing row data buffer become more complicated. Thus, the number may be chosen as required by the skilled person in view of these trade-offs according to the particular circumstances under consideration.

Other embodiments of the process described above include examples where the number of rows in each "group" comprises two (and in other examples, any other number higher than two as desired according to the circumstances, and trade-off situation, of any particular system under consideration). The present inventor has further considered another driving scheme with some similarities to the above described process. This further scheme may, in summary, be described (in terms of the above examples) as being as the above examples except that the rows within the second group of positive polarity rows are selected in the same order (direction), in the sense of ascending or descending row number order, as the rows within the first group of positive polarity rows, and likewise the rows within the second group of negative polarity rows are selected in the same order (direction), in the sense of ascending or descending row number order, as the rows within the first group of negative polarity rows. This difference means that the surprising benefits found in the above described schemes due to the reversal in order (direction) between the first and second group of a same polarity is not present. However, the present inventor has realised that, for groups of rows comprising three or more rows, these further schemes nevertheless tend to provide some degree of reduction in artefacts over prior art driving schemes.

An embodiment of such a further driving scheme will now be described with reference to FIGS. 8 and 9. This embodiment of a further driving scheme is implemented in the same device described above with reference to FIGS. 1 to 6, except where the row selection and column address control elements are adapted such as to control the row selection and data polarity addressing to be as described in the following. Furthermore, this embodiment again employs groups of six rows of each polarity, but as explained in the preceding paragraph, instead of six rows, other embodiments may employ a different number of rows, where the number is three or more.

As with the earlier described embodiments, the embodiments described below may be applied equally to any of the above described row or pixel inversion schemes. For clarity, the embodiments will again be described in terms of column 1 (e.g. of FIGS. 3 and 4) only.

FIG. 8 shows a driving scheme according to a further embodiment. FIG. 8 shows, for one frame, the polarity (where a "1" indicates a positive polarity, and a "−1" indicates a negative polarity) of data voltage (indicated by reference numeral 44) for a single column of the above described device as applied to each row number (indicated by reference numeral 42). For clarity only the first 24 rows, i.e. rows 1-24 are shown. FIG. 8 further shows the temporal order in which the rows are selected, as indicated by the time arrow 46. Thus, the first row to be selected is that whose polarity is shown in the far left column, i.e. row 2 which is driven with a positive polarity, then row 4 is selected and driven with a positive polarity, and so on. Thus it can be seen that the order of selection of the 24 rows shown in FIG. 5 is as follows (where +ve indicates positive polarity and −ve indicates negative polarity):

row 2 (+ve), row 4 (+ve), row 6 (+ve), row 8 (+ve), row 10 (+ve), row 12 (+ve), row 11 (−ve), row 9 (−ve), row 7 (−ve), row 5 (−ve), row 3 (−ve), row 1 (−ve), row 14 (+ve), row 16

(+ve), row 18 (+ve), row 20 (+ve), row 22 (+ve), row 24 (+ve), row 23 (−ve), row 21 (−ve), row 19 (−ve), row 17 (−ve), row 15 (−ve), row 13 (−ve).

The order of selection of the rows is based on groups of rows comprising six rows, such that a first group comprising the first six rows to be driven with positive polarity (i.e. rows 2, 4, 6, 8, 10 and 12) is selected in ascending row number order (i.e. in the order 2, 4, 6, 8, 10 12); following which a second group comprising the first six rows to be driven with negative polarity (i.e. rows 1, 3, 5, 7, 9 and 11) is selected in descending, i.e. reverse, row number order (i.e. in the order 11, 9, 7, 5, 3, 1); following which a third group comprising the next six rows to be driven with positive polarity (i.e. rows 14, 16, 18, 20, 22 and 24) is selected in ascending row number order (i.e. in the order 14, 16, 18, 20, 22, 24); following which a fourth group comprising the next six rows to be driven with negative polarity (i.e. rows 13, 15, 17, 19, 21, 23) is selected in descending, i.e. reverse, row number order (i.e. in the order 23, 21, 19, 17, 15, 13). The remaining rows of the device, i.e. row 25 onwards (not shown in FIG. 8) are selected by repeating this cycle of:

Alternating between: each next positive polarity group comprising the next six rows to be driven with positive polarity being selected in ascending row number order; and each next negative polarity group comprising the next six rows to be driven with negative polarity being selected in descending, i.e. reverse, row number order.

Figure 9:
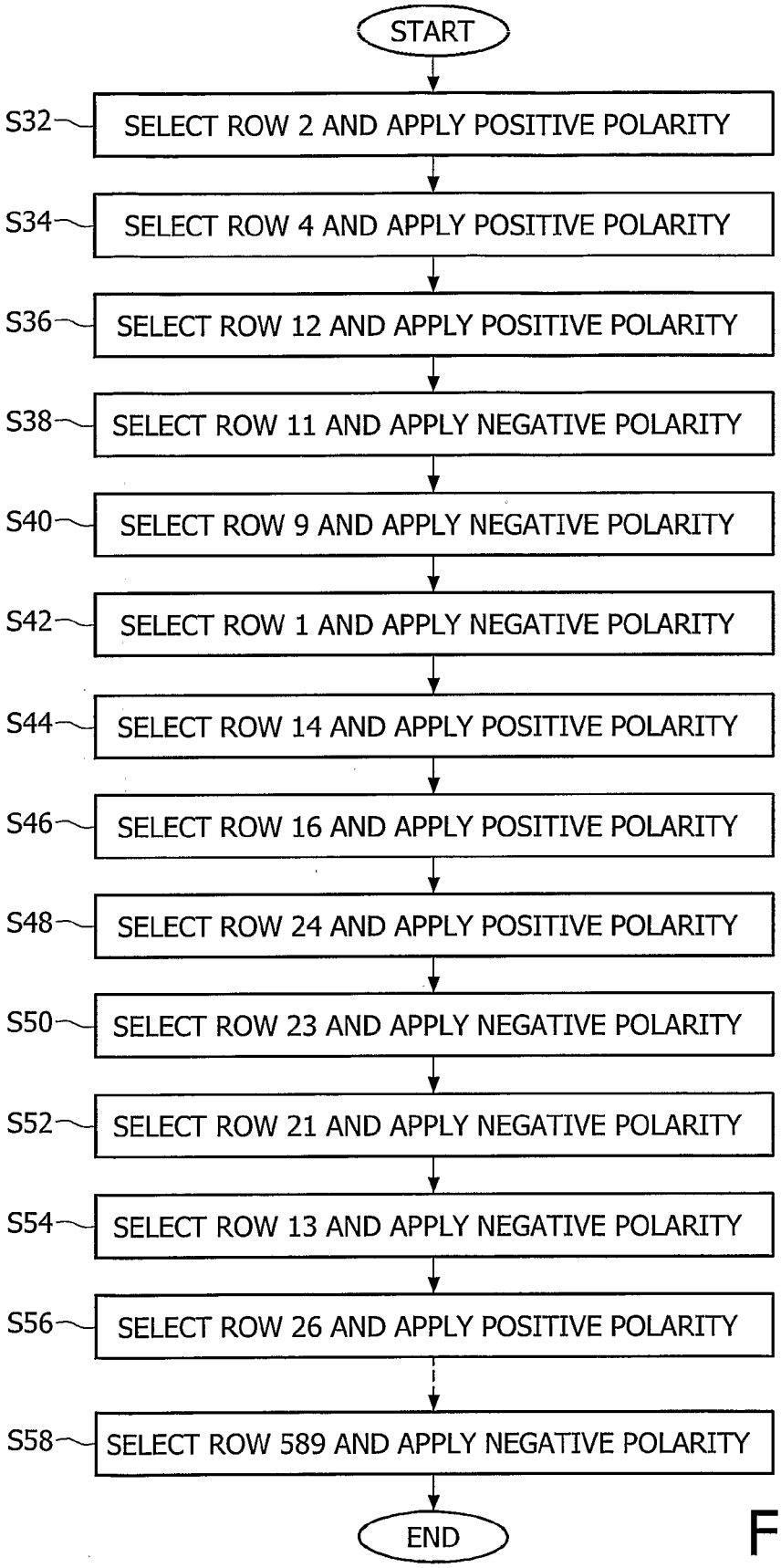
FIG. 9 is a flowchart showing process steps carried out by display driver apparatus implementing the driving scheme of FIG. 8.

FIG. 9 is a flowchart showing process steps carried out by the display driver apparatus in this embodiment to provide, for a single frame, the row ordering and polarities shown in FIG. 8, for the row inversion case.

At step s32, row 2 is selected and a positive polarity data voltage is applied to each column. Row 2 is selected by the row driver circuit 20 applying a selection voltage to row 2. Application of the positive polarity data voltage is implemented as described earlier with reference to the process of FIG. 5.

At step s34, the next row is selected, namely row 4, as this is the next consecutive row of the first group of six rows which are to have positive polarity applied thereto, and a positive polarity data voltage is applied to each of the columns.

This process is repeated (indicated by a broken arrow between step s34 and s36 in FIG. 9) for the remaining rows of the first group of six rows which are to have positive polarity applied thereto until, at step s36, row 12 is selected and a positive polarity data voltage is applied to each of the columns.

In this embodiment, the number of rows forming a "group" is six, hence the next six rows to be selected will be the first group of negative polarity rows (i.e. rows 1, 3, 5, 7, 9, and 11). Furthermore, as described above, this group will be selected in descending, i.e. reverse, row number order (i.e. 11, 9, 7, 5, 3, 1).

Thus, at step s38, row 11 is selected and a negative polarity data voltage is applied to each column. Next, at step s40, row 9 is selected and a negative polarity data voltage is applied to each column. This process is repeated (indicated by a broken arrow between step s40 and s42 in FIG. 9) for the remaining rows of the first group of six rows which are to have negative polarity applied thereto until, at step s42, row 1 is selected and a negative polarity data voltage is applied to each of the columns.

The next six rows to be selected will be the next group, i.e. the second group, of positive polarity rows (i.e. rows 14, 16, 18, 20, 22 and 24). Furthermore, as described above, in this embodiment this group will, in common with all the other positive polarity groups of rows, be again selected in ascending row number order (i.e. in the order 14, 16, 18, 20, 22, 24).

Thus at step s44, row 14 is selected and a positive polarity data voltage is applied to each column. Next, at step s46, row 16 is selected and a positive polarity data voltage is applied to each column. This process is repeated (indicated by a broken arrow between step s46 and s48 in FIG. 9) for the remaining rows of the second group of six rows which are to have positive polarity applied thereto until, at step s48, row 24 is selected and a positive polarity data voltage is applied to each of the columns.

The next six rows to be selected will be the next group, i.e. the second group, of negative polarity rows (i.e. rows 13, 15, 17, 19, 21, 23). Furthermore, as described above, this group will, in common with all the other negative polarity groups of rows, be again selected in descending, i.e. reverse, row number order (i.e. in the order 23, 21, 19, 17, 15, 13).

Thus, at step s50, row 23 is selected and a negative polarity data voltage is applied to each column. Next, at step s52, row 21 is selected and a negative polarity data voltage is applied to each column. This process is repeated (indicated by a broken arrow between step s52 and s54 in FIG. 9) for the remaining rows of the second group of six rows which are to have negative polarity applied thereto until, at step s54, row 13 is selected and a negative polarity data voltage is applied to each of the columns.

As described above, the remaining rows are selected and have positive or negative polarity applied to the columns in a repeat of the cycle described for rows 1-12 by allocating the rows into groups of six consecutive rows of a given polarity, then selecting them (and applying appropriate polarity data voltage to the columns) according to the cycle of:

the next group of positive polarity rows selected in ascending row number order (the first these being shown in FIG. 9 as step s56, in which row 26 is selected and a positive polarity data voltage is applied to each column), then the next group of negative polarity rows selected in descending row number order, then the next group of positive polarity rows selected in ascending row number order, then the next group of negative polarity rows selected in descending row number order, and so on (indicated by a broken arrow between step s26 and s28 in FIG. 9) until at step s58 the last to be selected row, i.e. the (m−11)th row (in this embodiment, where the display has say 600 rows by 800 columns, row 589) is selected and a negative polarity data voltage is applied to each column (the mth row, here row 600, having been selected previously as part of the last group of positive polarity rows, and the odd numbered rows from m−9 to m−1, here the odd rows from 591 to 599, having been selected previously).

This completes addressing of this frame. During addressing of the next frame, the positive and negative polarities are reversed, but the rows are selected in the order given above.

In the above described process, the row is selected then the voltage is applied to the column. Alternatively, this order may be reversed. Whichever order is used, it is usual for the column voltage to be held until after the row has been deselected.

It should again be borne in mind that the scheme has been described in detail for a given frame, however the polarities will then reverse in the next frame. Hence, whereas in the frame described above, the even numbered rows have positive polarity, in the next frame the odd numbered rows will have positive polarity.

Furthermore, various variations can be made to the above described addressing scheme whilst maintaining the underlying concept of selecting the rows within a group (as defined earlier) of rows of a first polarity in a first order (direction), in the sense of either ascending or descending row number order, followed by selecting the rows within the corresponding group of rows of the other polarity in the other order (direction), and then continuing this for each following pair of a first polarity group and a second polarity group. For example, in the process described with reference to FIGS. 8 and 9, the even numbered rows are selected, in each group, in ascending row number order, and the odd numbered rows are selected, in each group, in descending row order number. However, in an alternative embodiment, the odd numbered rows are selected, in each group, in ascending row number and the even numbered rows are selected, in each group, in descending row number order.

The invention may also be applied to other driving schemes in which different polarities are applied to different rows in a given column in arrangements other than alternate rows being different polarities. In such cases groups of rows of a given polarity are selected in the orders described above.

In the above embodiments, the components and operation of the display driver apparatus are an example using an analogue column driver circuit 22. However, in other embodiments, a digital column driver may be used, in particular the digital column driver may comprise a digital shift register and a digital-to-analogue (D/A) converter for each column. In these cases, the display driver apparatus will be adapted as required.

Finally, although the above embodiments have all been described in relation to a particular liquid crystal display device, it will be appreciated that the row selection of the present invention may also be applied in other liquid crystal display devices, and in other types of display devices requiring or potentially benefiting from inverted polarity column driving. For example, in the above embodiments, the liquid crystal display device is a transmissive device. However, in other embodiments the liquid crystal display device may be a reflective device or a transflective device.

The invention claimed is:

1. A method of driving an array of pixels (12) arranged in rows (1 to m) and columns (1 to n); the method comprising:

selecting the rows (1 to m) of pixels (12) one row at a time; and applying respective data voltages to the columns (1 to n) of pixels (12) each time a row is selected, the polarity of the data voltage applied to a given column being inverted between a first polarity and a second polarity such that positionally successive rows are driven with a different polarity of data voltage;

selecting the rows (1 to m) of pixels (12) one row at a time comprising the following steps performed in the following order:

(i) successively selecting, in a first order, the rows of a first group of first polarity rows being positionally successive rows of those rows being driven with the first polarity;

(ii) successively selecting, in a second order, the rows of a first group of second polarity rows being positionally successive rows of those rows being driven with the second polarity, the rows of the first group of first polarity rows and the rows of the first group of second polarity rows being positionally interlaced such that together they are a plurality of positionally successive rows;

(iii) successively selecting, in the second order, the rows of a second group of first polarity rows being positionally successive rows of those rows being driven with the first polarity; and (iv) successively selecting, in the first order, the rows of a second group of second polarity rows being positionally successive rows of those rows being driven with the second polarity, the rows of the second group of first polarity rows and the rows of the second group of second polarity rows being positionally interlaced such that together they are a plurality of positionally successive rows which positionally succeeds the plurality of positionally successive rows of, together, the first group of first polarity rows and the first group of second polarity rows;

wherein the first order is one of ascending or descending row number order, and the second order is the other of ascending or descending row number order.

2. A method according to claim 1, wherein each group of first polarity rows or second polarity rows comprises three or more rows.

3. A method according to claim 1, wherein the pixels (12) are pixels of an active matrix liquid crystal display.

4. Display driver apparatus for driving an array of pixels (12) arranged in rows (1 to m) and columns (1 to n), comprising:

means for selecting the rows (1 to m) of pixels (12) one row at a time; and means for applying respective data voltages to the columns (1 to n) of pixels (12) each time a row is selected, the polarity of the data voltage applied to a given column being inverted between a first polarity and a second polarity such that positionally successive rows are driven with a different polarity of data voltage;

the means for selecting the rows (1 to m) of pixels (12) one row at a time being adapted to perform selection of the rows (1 to m) by implementing the following steps in the following order:

(i) successively selecting, in a first order, the rows of a first group of first polarity rows being positionally successive rows of those rows being driven with the first polarity;

(ii) successively selecting, in a second order, the rows of a first group of second polarity rows being positionally successive rows of those rows being driven with the second polarity, the rows of the first group of first polarity rows and the rows of the first group of second polarity rows being positionally interlaced such that together they are a plurality of positionally successive rows;

(iii) successively selecting, in the second order, the rows of a second group of first polarity rows being positionally successive rows of those rows being driven with the first polarity; and (iv) successively selecting, in the first order, the rows of a second group of second polarity rows being positionally successive rows of those rows being driven with the second polarity, the rows of the second group of first polarity rows and the rows of the second group of second polarity rows being positionally interlaced such that together they are a plurality of positionally successive rows which positionally succeeds the plurality of positionally successive rows of, together, the first group of first polarity rows and the first group of second polarity rows;

wherein the first order is one of ascending or descending row number order, and the second order is the other of ascending or descending row number order.

5. Display driver apparatus according to claim 4, wherein each group of first polarity rows or second polarity rows comprises three or more rows.

6. A display device comprising an array of pixels (12) arranged in rows (1 to m) and columns (1 to n), and display driver apparatus according to claim 4.

7. A method of driving an array of pixels (12) arranged in rows (1 to m) and columns (1 to n); the method comprising:

selecting the rows (1 to m) of pixels (12) one row at a time; and applying respective data voltages to the columns (1 to n) of pixels (12) each time a row is selected, the polarity of the data voltage applied to a given column being inverted between a first polarity and a second polarity such that positionally successive rows are driven with a different polarity of data voltage;

selecting the rows (1 to m) of pixels (12) one row at a time comprising the following steps performed in the following order:

(i) successively selecting, in a first order, the rows of a first group of three or more first polarity rows being positionally successive rows of those rows being driven with the first polarity; and (ii) successively selecting, in a second order, the rows of a first group of three or more second polarity rows being positionally successive rows of those rows being driven with the second polarity, the rows of the first group of first polarity rows and the rows of the first group of second polarity rows being positionally interlaced such that together they are a plurality of positionally successive rows;

wherein the first order is one of ascending or descending row number order, and the second order is the other of ascending or descending row number order.

8. A method according to claim 7, wherein the pixels (12) are pixels of an active matrix liquid crystal display.

9. Display driver apparatus for driving an array of pixels (12) arranged in rows (1 to m) and columns (1 to n), comprising:

means for selecting the rows (1 to m) of pixels (12) one row at a time; and means for applying respective data voltages to the columns (1 to n) of pixels (12) each time a row is selected, the polarity of the data voltage applied to a given column being inverted between a first polarity and a second polarity such that positionally successive rows are driven with a different polarity of data voltage;

the means for selecting the rows (1 to m) of pixels (12) one row at a time being adapted to perform selection of the rows (1 to m) by implementing the following steps in the following order:

(i) successively selecting, in a first order, the rows of a first group of three or more first polarity rows being positionally successive rows of those rows being driven with the first polarity; and (ii) successively selecting, in a second order, the rows of a first group of three or more second polarity rows being positionally successive rows of those rows being driven with the second polarity, the rows of the first group of first polarity rows and the rows of the first group of second polarity rows being positionally interlaced such that together they are a plurality of positionally successive rows;

wherein the first order is one of ascending or descending row number order, and the second order is the other of ascending or descending row number order.

10. A display device comprising an array of pixels (12) arranged in rows (1 to m) and columns (1 to n), and display driver apparatus according to claim 9.

* * * * *